US005632639A

United States Patent [19]

Hayashi

[11] Patent Number: 5,632,639

[45] Date of Patent: May 27, 1997

[54] CONNECTOR ASSEMBLY INCLUDING MALE AND FEMALE CONNECTORS HAVING WATER-RESISTANT PLATES TO PREVENT CURRENT LEAKAGE

[75] Inventor: Hiroyuki Hayashi, Yokkaichi, Japan

[73] Assignee: Sumitomo Wiring Systems, Ltd., Yokkaichi, Japan

[21] Appl. No.: 289,107

[22] Filed: Aug. 11, 1994

[30] Foreign Application Priority Data

Aug. 26, 1993 [JP] Japan ..... 5-235590

[51] Int. Cl.[6] ..... H01R 13/52

[52] U.S. Cl. ..... 439/271; 439/934

[58] Field of Search ..... 439/181, 183, 439/271, 682, 692, 699, 934.1

[56] References Cited

U.S. PATENT DOCUMENTS

| | | | |
|---|---|---|---|
| 4,552,907 | 11/1985 | Sato et al. | 523/455 |
| 4,701,662 | 10/1987 | Yamanashi et al. | 313/51 |
| 5,063,314 | 11/1991 | Desantis | 439/934.1 |
| 5,145,404 | 9/1992 | Beattie et al. | 439/934.1 |

FOREIGN PATENT DOCUMENTS

| | | | |
|---|---|---|---|
| 2475303 | 8/1981 | France | 439/181 |
| 1490808 | 7/1972 | Germany . | |
| 251269 | 11/1987 | Germany . | |
| 3714552 | 11/1988 | Germany . | |
| 5657486 | 10/1952 | Japan . | |
| 5589280 | 12/1953 | Japan . | |

*Primary Examiner*—Hien Vu

*Attorney, Agent, or Firm*—Wenderoth, Lind & Ponack

[57] ABSTRACT

A connector of an electrical connector assembly includes a housing defining a pair of parallel cavities extending therethrough, and a partition wall partitioning the cavities from one another. A leakage-prevention plate having a finlike configuration is interposed between the open ends of the two cavities. Thus, the path of least resistance between terminal fixtures within the respective cavities extends over both surfaces of the leakage-prevention plate. For this reason, the value of leakage current between the fixtures retained by the same connector will be extremely small, and the electrical corrosion of the terminal fixtures will be reliably suppressed. Furthermore, the leakage-prevention plate may possess a high degree of water repellency by being formed of an oil-impregnated resin in which particles of lubricating oil are dispersed within synthetic resin and/or by having the surfaces machined to a mirror finish. This prevents a continuous band of water from developing between the two terminal fixtures. The above structure may be applied to a male and/or a female connector of the connector assembly.

7 Claims, 4 Drawing Sheets

CONNECTOR ASSEMBLY INCLUDING MALE AND FEMALE CONNECTORS HAVING WATER-RESISTANT PLATES TO PREVENT CURRENT LEAKAGE

BACKGROUND OF THE INVENTION

1. Field of the Invention

The present invention relates to a connector which, when performing electrical wiring, is used to establish a male-female union at ends of the electrical wires and, more particularly, to such a connector provided with a water-resistant structure wherein current will not leak between respective terminal fixtures.

2. Description of the Related Art

In a connector assembly including male and female connectors each provided with a plurality of cavities, when a potential difference occurs between terminal fixtures within adjacent cavities while the connector is wet, current flows (referred to as "leakage current") between the two terminal fixtures. When leakage current flows, the terminal fixtures may corrode (i.e., electrical corrosion), and so various water-resistant structures have been considered in the prior art in order to prevent this problem.

These structures include a completely water-resistant structure and a simplified water-resistant structure.

FIG. 5 is a sectional view of a connector implementing a completely water-resistant structure.

A rubber plug 2 and insulated electrical wire 3 are crimped by the rear end of a male terminal fixture 1. The male terminal fixture 1 is inserted into a cavity 6 formed in a housing 5 of a male connector 4. The housing 5 is formed with a plurality of parallel cavities 6, and respective open ends of the cavities are sealed by the rubber plug.

Further, a hood 8, which receives a mating connector 7, is formed at the other end of the housing 5. An annular seal 9 is disposed in a space within the hood 8. When the mating connector 7 is housed within the hood 8, the annular seal 9 is interposed between the inner peripheral surface of the hood 8 and the outer peripheral surface of the mating connector 7 to provide resistance to water.

Although complete water resistance can be expected if a rubber plug 2 and seal 9 are used in this manner, the rubber plug 2 and seal 9 contribute to a comparatively high cost of the assembly, and the operation of passing the insulated electrical wire 3 through the rubber plug 2 is troublesome. Because of this, a simpler water-resistant structure is employed, for example, in the upper areas of an engine compartment of an automobile and similar locations where the chance of water penetration is small.

Japanese Laid-Open Utility Model Application No. 56-57486 discloses such a known simplified water-resistant structure.

An end of a connector housing wherein a terminal fixture is inserted in a cavity is formed with a groove provided between adjoining ones of such cavities. As a result of the provision of such a groove, a path of least resistance between the two cavities traverses the groove, thereby impeding leakage current between the cavities.

One of the connectors is provided with a hood in the form of a double frame comprising an inner frame and outer frame. The other connector is provided with a hood in the form of a single frame insertable within the clearance between the inner and outer frames. When the respective hoods are brought together and the single hood is inserted into and mated with the double hood, it is difficult for water to penetrate past the mating portions of connectors, and so the generation of leakage current between cavities within the connectors is prevented.

However, the connector assembly having the above-described simplified water-resistant structure has the following problems.

Because a groove is formed between the cavities water may penetrate into the groove, i.e. it is possible for the interior of the groove to become submerged in water. In such a case, a large leakage current can flow between the cavities and the electrical corrosion of the terminal fixtures cannot be prevented.

Furthermore, with regard to the mating portions of the male and female connectors, three layers of hoods overlap, and so the external dimensions of the mating portions are necessarily large and the overall size of the connector assembly is correspondingly comparatively large.

SUMMARY OF THE INVENTION

Accordingly, objects of the present invention are to provide a connector which possesses an effective water-resistant characteristic, which has a simple structure, and which is capable of suppressing electrical corrosion of terminal fixtures due to leakage current.

To achieve these objects, a connector of the present invention includes a housing defining a pair of parallel cavities in which terminal fixtures connected to insulated electrical wires are retained, and a partition wall partitioning the cavities from one another, and further includes a planar leakage-prevention plate protruding from a location between open ends of the cavities.

Thus, the length of a path of least resistance between the cavities, and hence the terminal fixtures, extends over both surfaces of the leakage-prevention plate. Because this path is long even if leakage current flows between the cavities, the magnitude of the current is minimal.

The leakage-prevention plate may be formed of an oil-impregnated resin.

The oil content of the oil-impregnated resin exhibits water repellency so that even if water adheres to the leakage-prevention plate, the water runs off quickly without collecting. Accordingly, a continuous band of water between the cavities is eliminated so that the leakage current can be impeded.

Moreover, the water repellency of the leakage-prevention plate may be enhanced by imparting a mirror finish to the surfaces of the plates by any known method, whereby again, water will run off the plate quickly without collecting.

A further object of the present invention is to provide a connector assembly which employs the above-described connector as at least one of male and female connectors and which is compact.

To achieve this object, the connectors comprise a pair of housings mated at respective portions thereof at which respective male and female terminal fixtures are maintained in an electrically conductively connected state, and a water-resistant seal disposed in the mated portions of the connector housings.

In this connector, the water-resistant seal prevents the penetration of water to the terminal fixtures and so the mated portions of the connector need not have three superposed walls as in the prior art. Hence, the connector is comparatively compact.

BRIEF DESCRIPTION OF THE DRAWINGS

These and other objects, features and advantages of the present invention will become more apparent to those of ordinary skill in the art from the detailed description of a preferred embodiment of the invention made below with reference to the accompanying drawings, of which.

DETAILED DESCRIPTION OF THE PREFERRED EMBODIMENT

Figure 1:
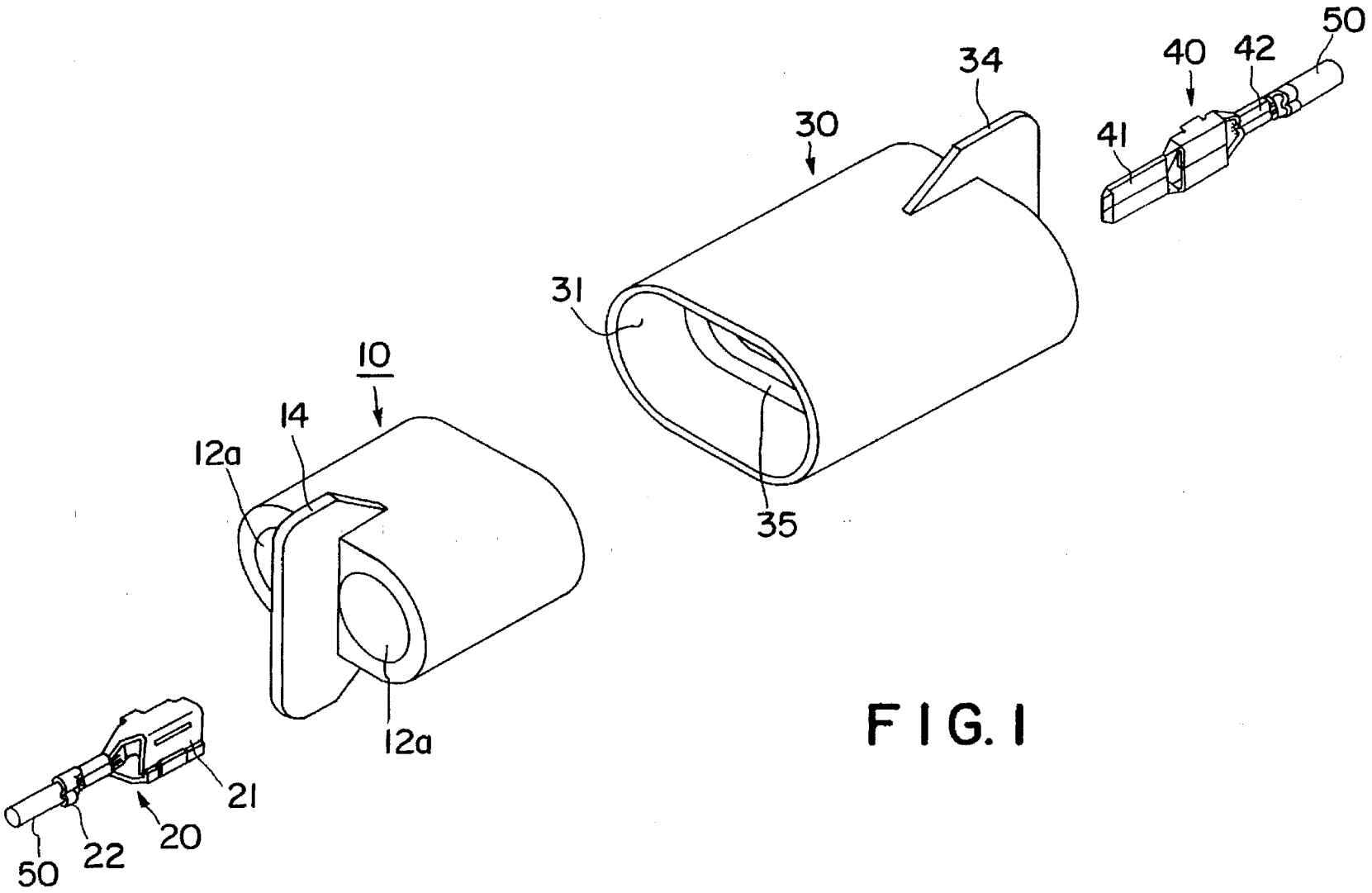
FIG. 1 is an exploded perspective view of a connector assembly according to the present invention.

An embodiment of the present invention will be described with reference to the accompanying drawings. FIGS. 1 to 4 depict male and female connectors of an embodiment of a connector assembly according to the present invention. The female connector 10 includes a housing in which two female terminal fixtures 20 are retained in line. The male connector 30 includes a housing in which two male terminal fixtures 40 are retained in line. These male terminal fixtures 40 are paired with the female terminal fixtures 20, respectively, when the female connector 10 is inserted within a hood 31 at the front of the male connector 30. The female connector 10 and male connector 30 are respectively formed of oil-impregnated resin in which particles of lubricating oil are dispersed within synthetic resin, and the surfaces exhibit water repellency because of the oil in the oil-impregnated resin. The male terminal fixtures 40 are each provided at one end with a male terminal 41 having a planar configuration and at the other end with a crimp contact which is crimped to a tip of an insulated electrical wire 50. Each female terminal fixture 20 is provided at one end with a female terminal 21 having a tubular configuration and into which the male terminal 41 is insertable, and at the other end with a crimp contact 22 which similarly is crimped to a tip of an insulated electrical wire 50.

Figure 2:
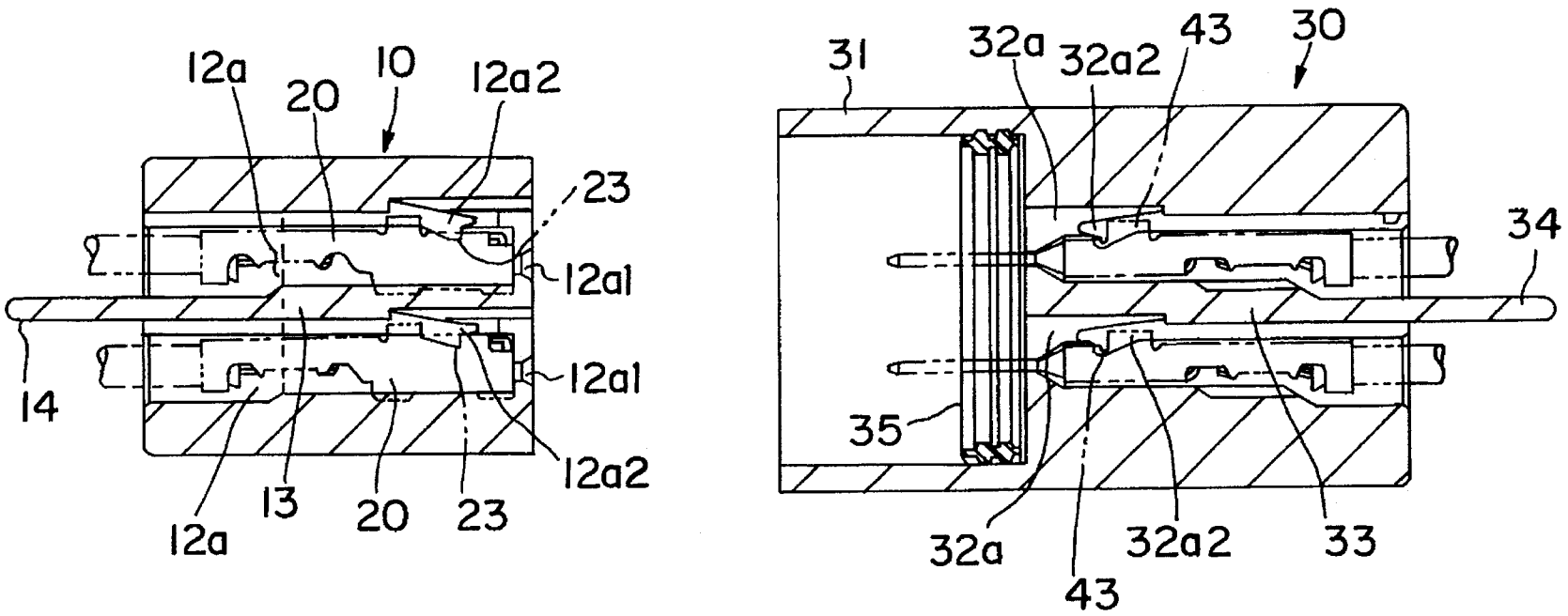
FIG. 2 is a sectional view of male and female connectors of the connector assembly prior to being mated.

As shown in FIG. 2, the female connector 10 has two parallel cavities 12*a* extending axially therethrough to allow the female terminal fixtures 20 to be inserted into the female connector. The rear end of each cavity 12*a* opens at the rear of the female connector 10 but the front end is open via a small hole 12*a*1 in the housing to allow a male terminal 41 of a male terminal fixture 40 to be inserted thereinto. Moreover, a lance 12*a*2 projects into each cavity 12*a* so as to enter a retaining hole 23 formed in the side of the corresponding female terminal fixture 20 and thereby prevent the female terminal fixture 20 from being dislodged from the female connector 10.

Figure 3:
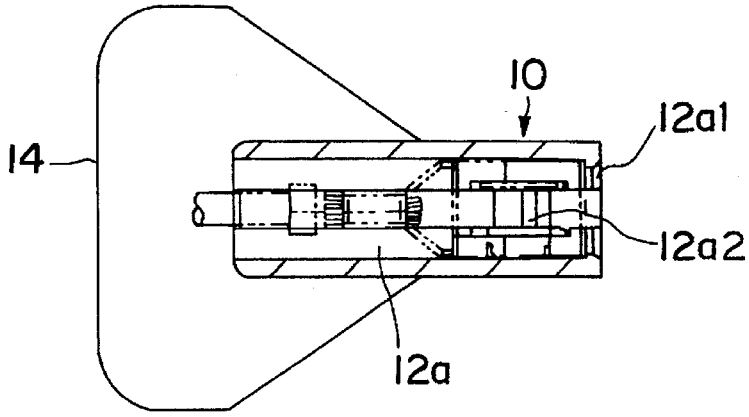
FIG. 3 is a sectional view of the female connector.
Figure 5:
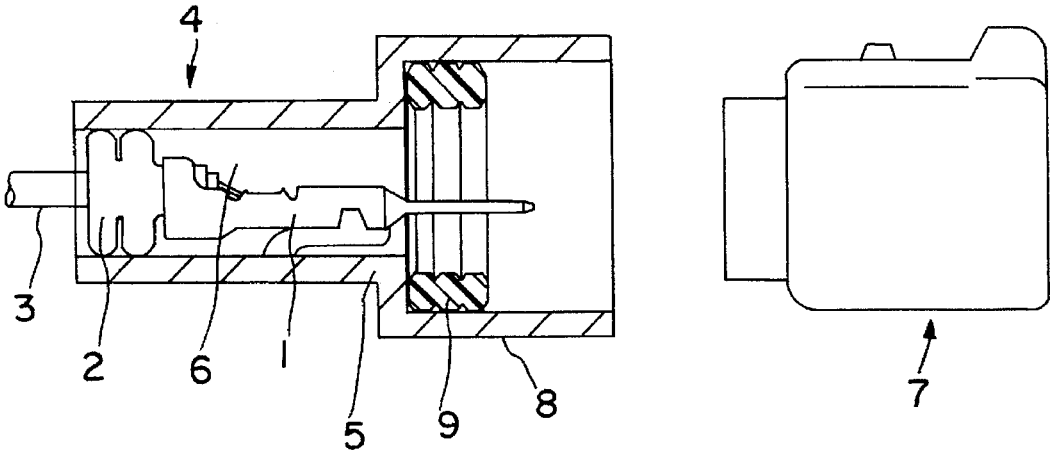
FIG. 5 is a side view, partially in section, of a connector assembly according to the prior art.

The two cavities 12*a* are separated by a partition wall 13 extending within the female connector 10. As shown in FIG. 3, a leakage-prevention plate 14 having a planar configuration protrudes at the exterior of the female connector 10 from a location between the two cavities 12*a*, thereby forming a partition between the open rear ends of the two cavities 12*a*. More specifically, the plate extends perpendicular to a plane passing through the centers of the cavities 12*a* as contiguous to a portion (partition wall) of the housing defining the cavities 12*a*. The surfaces of this leakage-prevention plate 14 are machined to a mirror finish, and along with the water repellency of the lubrication oil, the water repellency of the female connector 10 is further enhanced by the mirror finish. Moreover, the leakage-prevention plate 14 has a rear end remote from the cavities 12*a* and which has a uniform width which is greater than the distance between the upper and lower surfaces of the female connector 10. The leakage-prevention plate 14 also has a front end at which the plate gradually approaches the upper and lower surfaces of the female connector 10 from a location forward of the open ends of the cavities 12*a*, whereby the plate 14 has an overall finlike configuration.

The male connector 30, as shown in FIG. 2, has two parallel cavities 32*a* extending axially therethrough to allow the male terminal fixtures 40 to be inserted into the male connector. The hood 31 of the male connector 30 comprises a wall surrounding the front open ends of the cavities 32*a*. The hood 31 allows the end of the female connector 10 having the small holes 12*a*1 to be inserted thereinto. Furthermore, a lance 32*a*2 protrudes into each cavity 32*a* so as to enter a retaining hole 43 formed in the side of the corresponding male terminal fixture 40 to thereby prevent the male terminal fixture 40 from being dislodged from the male connector 30. When a male terminal fixture 40 is inserted into a cavity 32*a* and retained by the lance 32*a*2, the male terminal 41 will protrude from the cavity 32*a* into a space interior of the hood 31.

A water-resistant rubber seal 35 is disposed in this space. The seal has an annular configuration with ribs on the inner and outer surfaces thereof and is maintained in a sealed state with the inner peripheral surface of the hood 31. The ribs of the water-resistant seal 35 will become slightly flattened between the outer peripheral surface of the female connector 10 and the inner peripheral surface of the hood 31 when the female connector 10 has been inserted into the hood 31.

Figure 4:
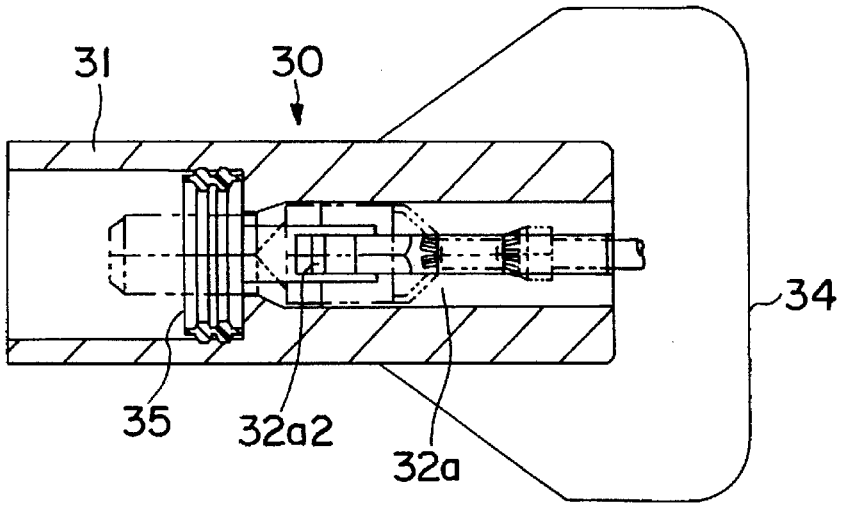
FIG. 4 is a sectional view of the male connector.

The two cavities 32*a* of the male connector 30 are also separated by a partition wall 33. As shown in FIG. 4, a leakage-prevention plate 34 having a planar configuration protrudes at the exterior of the male connector 30 from a location between the two cavities 32*a*, thereby forming a partition between the open ends of the two cavities 32*a*. This plate 34 also extends perpendicular to a plane passing through the longitudinal center axes of the cavities 32*a* and is contiguous to a portion of the housing (partition wall) defining the cavities 32*a*. The surfaces of this leakage-prevention plate 34 are also machined to a mirror finish, and along with the water repellency of the lubrication oil, the water repellency of the male connector 30 is further enhanced by the mirror finish. The leakage-prevention plate 34 has a rear end remote from the cavities 32*a* and which has a uniform width greater than the distance between the upper and lower surfaces of the male connector 30. The leakage-prevention plate 34 also has a front end at which the plate gradually approaches the upper and lower surfaces of the male connector 30, whereby the plate 34 has an overall finlike configuration.

Next, the function of the above-described connector assembly will be described.

The tip of an insulated electrical wire 50 which has been stripped of insulation is crimped by the crimp contact 12 of a female terminal fixture 20, the female terminal fixture 20 is inserted within a cavity 12*a* of the female connector 10, and the lance 12*a*2 enters the retaining hole 23 to prevent the female terminal fixture 20 from being dislodged. The tip of another insulated electrical wire 50 which has been stripped of insulation is crimped by the crimp contact 42 of a male terminal fixture 40, the male terminal fixture 40 is inserted within a cavity 32*a* of the male connector 30, and the lance 32*a*2 enters the retaining hole 43 to the male terminal fixture 40 from being dislodged.

The end of the female connector 10 provided with holes 12*a*1 is inserted within the hood 31 of the male connector 30. As the end of the female connector 10 advances within the hood 31, the male terminals 41 of the male terminal fixtures 40 protruding inside of the hood 31 enter the small holes 12*a*1 in the female connector 10, and are then inserted into the female terminals 21 of the female terminal fixtures 20 to establish an electrically conductive connection between the male and female terminal fixtures.

When the female connector 10 is inserted completely into the hood 31 of the male connector 30, the end of the female connector 10 is forced into the annular water-resistant seal 35, and so the ribs of the seal 35 become slightly flattened between the inner peripheral surface of the hood 31 and the outer peripheral surface of the female connector 10. This portion is thereupon maintained in a completely watertight state, and even if water flows into the hood 31, there is no chance of the water penetrating to the cavities 32*a* of the male connector 30. Additionally, because only the end of the female connector 10 is received in the interior of the hood 31, the hood may have smaller overall external dimensions than the triple-layer connector according to the prior art, thereby achieving compactness.

However, the insulated electrical wires 50 extend from the ends of the connectors 10 and 30 which are provided with the leakage-prevention plates 14 and 34, and the respective cavities 12*a* and 32*a* remain open at these ends. Consequently, water may be splashed onto the female connector 10 or male connector 30 or onto a female terminal fixture 20 or male terminal fixture 40 within the respective cavities 12*a*, 32*a*. However, because the leakage-prevention plates 14 and 34 as well as the female connector 10 and male connector 30 are formed of oil-impregnated resin, the moisture rapidly runs off of these elements. For this reason, continuous bands of moisture are prevented from forming along the several terminal fixtures 20, and 40, and therefore no leakage current is produced. Moreover, the surfaces of the plates 14 and 34 possessing a mirror finish further prevent the adhesion of water droplets.

Additionally, even if, for example, the respective terminal fixtures 20 and 40 are submerged in water, the paths of least resistance between the respective terminal fixtures 20 and 40 extend over both surfaces of the leakage-prevention plates 14 and 34, respectively. Therefore, the magnitude of the leakage current which flows is extremely small, and the electrical corrosion of the terminal fixtures 20 and 40 caused by the leakage current is suppressed.

When the female connector 10 and male connector 30 are to be separated, the connectors can be gripped at the leakage-prevention plates 14 and 34 and extracted from one another with ease due to the orientation of the plates 14 and 34.

Although a preferred embodiment has been described above with reference to the drawings, the present invention is not limited to the embodiment but may encompass various changes and modifications as will become apparent to those of ordinary skill in the art. For instance, although the present invention has been described with respect to a bipolar electrode provided with two cavities, the invention can also be applied to a connector including a housing defining three or more cavities. The leakage-prevention plates will be appropriately disposed according to the arrangement of the cavities so as to interrupt all direct paths between the open ends of the cavities.

Further, although the water-resistant seal 35 has been described as being disposed within the hood 31 of a male connector 30, the water-resistant seal 35 may be instead provided on the outer periphery of the front end of the female connector 10. Moreover, lock mechanisms may be provided on the outer peripheral surfaces of the female connector 10 and male connector 30 to maintain detachably secure the connectors 10 and 30 when they are mated, i.e. when the front end of the female connector 10 has been inserted into the hood 31.

All such changes and modifications are seen to be within the true spirit and scope of the invention as defined by the appended claims.

What is claimed is:

1. An electrical connector for use in connecting electrical wires to one another, said connector comprising a housing being of oval shape defining a pair of substantially parallel circular cavities extending axially therethrough, the cavities having ends open at a rear portion of the housing, a partition wall partitioning said cavities from one another within the housing, and a planar leakage-prevention plate protruding at the exterior of the housing from a location between said ends of the cavities, said leakage-prevention plate being of a resin impregnated with an oil whereby a path of least resistance between electrical wiring led out of said cavities will extend around said leakage-prevention plate and the leakage-prevention plate will repel water such that current leaking between electrical wires in the connector is suppressed.

2. A connection as claimed in claim 1, wherein said housing has an annular hood at one end thereof, and further comprising a water-resistant seal disposed radially inwardly of the hood and in contact therewith.

3. A connector as claimed in claim 1, wherein said planar leakage-prevention plate has opposite surfaces exhibiting a mirror finish.

4. An electrical connector assembly comprising: a male connector, a female connector receiving and mated with said male connector, at least one of said connectors comprising a housing being of oval shape defining a pair of substantially parallel circular cavities extending axially therethrough, the cavities having ends open at a rear portion of the one of said connectors remote from the other of said connectors, and a partition wall partitioning said cavities from one another within the housing; electrical wiring retained by said one of said connectors, said wiring including metal terminals retained in the cavities of said housing, respectively, and insulated wires electrically connected to said terminals, respectively, and led out from said ends of the cavities; and said at least one of the connectors including a leakage-prevention plate protruding at the exterior of the housing from a location between said ends of the cavities, said leakage-prevention plate being of a resin impregnated with an oil whereby a path of least resistance between the metal terminals of the wiring will extend around said leakage-prevention plate and said leakage-prevention plate will repel water such that current leaking between the metal terminals of said wiring will be suppressed.

5. A connector as claimed in claim 4, and further comprising a water-resistant seal in said housing of the male connector, said seal being interposed between said male and said female connectors.

6. A connector as claimed in claim 4, wherein said planar leakage-prevention plate has opposite surfaces exhibiting a mirror finish.

7. A connector as claimed in claim 4, wherein each of said connectors comprises a housing defining a pair of parallel cavities extending axially therethrough, a partition wall partitioning said pair of parallel cavities from one another within said housing, and a leakage-prevention plate protruding at the exterior of said housing from a location between ends of the cavities.

* * * * *